US007537472B1

(12) United States Patent
Schwarz et al.

(10) Patent No.: US 7,537,472 B1
(45) Date of Patent: May 26, 2009

(54) ELECTRIC PLUG CONNECTOR

(75) Inventors: Gerhard Schwarz, Schoenbrunn-Allemuehl (DE); Reiner Naumann, Mannheim (DE); Helmut Deschner, Eberbach (DE); Theo Grimm, Mudau (DE); Gerd Hofmann, Eberbach (DE); Dieter Sauer, Heddesbach (DE)

(73) Assignee: Cooper Crouse-Hinds GmbH, Soest (DE)

( * ) Notice: Subject to any disclaimer, the term of this patent is extended or adjusted under 35 U.S.C. 154(b) by 0 days.

(21) Appl. No.: 10/069,760

(22) PCT Filed: May 23, 2000

(86) PCT No.: PCT/EP00/04697

§ 371 (c)(1), (2), (4) Date: Sep. 23, 2002

(87) PCT Pub. No.: WO01/17070

PCT Pub. Date: Mar. 8, 2001

(30) Foreign Application Priority Data

Aug. 31, 1999 (DE) ..... 299 15 263 U

(51) Int. Cl.
*H01R 29/00* (2006.01)

(52) U.S. Cl. ..... 439/188; 439/333

(58) Field of Classification Search ..... 439/333, 439/332, 318, 188

See application file for complete search history.

(56) References Cited

U.S. PATENT DOCUMENTS 3,023,394 A 2/1962 Hubbell
3,525,068 A * 8/1970 Nelson ..... 439/138
3,789,346 A 1/1974 DeBrick
3,808,579 A 4/1974 Mina et al.
3,853,376 A 12/1974 Marechal
4,193,655 A * 3/1980 Herrmann, Jr. ..... 439/166
4,198,110 A 4/1980 Wetmore et al.
4,772,215 A * 9/1988 Falk ..... 439/188
5,386,486 A * 1/1995 Fan et al. ..... 385/59
5,417,594 A 5/1995 Herman et al.
5,423,692 A 6/1995 Francis
5,697,798 A 12/1997 Marechal
6,162,082 A 12/2000 Karsten et al.
6,206,714 B1 3/2001 Bernardini
6,382,990 B1 5/2002 Marechal et al.

(Continued)

FOREIGN PATENT DOCUMENTS

CH 311 948 12/1955

(Continued)

*Primary Examiner*—Neil Abrams
*Assistant Examiner*—Phuong Nguyen
(74) *Attorney, Agent, or Firm*—Fish & Richardson P.C.

(57) ABSTRACT

The electric plug connector is intended to be used especially for explosion-proof areas. It comprises a plug and a socket. The latter includes in a housing a socket insert which, in the inserted condition of the plugs, is supported such that it is rotatable between an off position and an on position. In said socket a locking means is supported such that it is adjustable between a locking position and a release position, said locking means being provided with at least one coding projection which, in the condition in which the plug is inserted in the socket, projects into a complementary coding aperture and releases the locking means, whereupon the socket can be switched from said off position to said on position.

24 Claims, 6 Drawing Sheets

U.S. PATENT DOCUMENTS

| | | | | |
|---|---|---|---|---|
| 6,386,897 | B1 | 5/2002 | Muller | |
| 6,551,136 | B2 * | 4/2003 | Johnsen et al. | 439/578 |
| 6,764,351 | B2 * | 7/2004 | Finzer et al. | 439/752 |
| 6,840,793 | B2 * | 1/2005 | Finzer et al. | 439/465 |
| 7,066,758 | B2 * | 6/2006 | Schwarz et al. | 439/333 |
| 7,316,584 | B2 * | 1/2008 | Mackillop et al. | 439/608 |

FOREIGN PATENT DOCUMENTS

| | | | |
|---|---|---|---|
| DE | 558 669 | | 9/1932 |
| DE | 2 832 105 | A1 | 1/1980 |
| EP | 0 151 715 | A2 | 8/1985 |
| FR | 1 103 645 | | 11/1955 |
| FR | 2 266 332 | | 10/1975 |
| FR | 2734668 | | 11/1996 |

* cited by examiner

ELECTRIC PLUG CONNECTOR

The present invention relates to an electric plug connector, in particular for explosion-proof areas, comprising a plug and a socket, which includes at least one housing and a socket insert supported in said housing such that it is rotatable between off and on positions, said socket insert being adapted to be rotated between its positions by means of the plug inserted in the socket.

An electric plug connector of this type which permits voltage-free plugging and switching on, especially for explosion-proof areas, is known in practice. The plug connector is a circular connector in which a contact-bearing socket insert can be arranged at various positions (off or on positions). A differentiation with respect to different types of currents, voltages, frequencies or the like is made possible by a suitable arrangement of contact pins within the plug.

It is the object of the subject matter of the application to improve the electric plug connector mentioned at the start insofar as an additional safety means is provided, which, in the case of otherwise compatible plugs and sockets, prevents electric switching on of the plug connector in a simple manner. With the aid of this safety means, e.g. certain industrial equipment can be prevented from functioning in explosion-proof areas.

In connection with the features of the generic clause of claim 1, this object is achieved by the features that a locking means is supported in the socket insert such that it is displaceable between a locking position and a release position, said locking means being provided with at least one coding projection which, in the condition in which the plug is inserted in the socket insert, is adapted to be arranged in a complementary coding aperture in the plug thus arranging the locking means at its release position, the socket insert being rotatable between the off and on positions when the locking means is in the release position.

Hence, the present invention is so conceived that, in the case of otherwise identical structural designs of plugs, only the plug having the complementary coding aperture permits switching on of the electric plug connector. If such a plug has a different coding aperture or no complementary coding aperture, the locking means will remain at its locking position and the socket insert cannot be rotated from its off position to its on position.

The locking means can have different structural designs. One possibility is a locking means which is supported in the socket insert in a radially displaceable manner and which, in the case of plugs having no complementary coding aperture, prevents a rotation of the socket insert relative to the housing, whereas in the case of plugs having a complementary coding aperture, it is displaceable radially inwards towards the coding aperture, whereby the socket insert is released for rotation. In the case of a further simple embodiment, the locking means can be implemented as a locking pin which is supported in the socket insert such that it is longitudinally displaceable between the locking and release positions essentially in the plug-in direction of the plug.

In order to check, in an optically simple manner, whether the plug and the socket belong together, the locking pin may, when occupying the release position, project with one of its ends as a coding projection beyond the socket insert in the direction of the plug. In this way, it can be checked optically whether the coding projection and the coding aperture formed in the plug match.

In order to displace the locking pin automatically in the direction of the plug, the locking pin may have a force applied thereto in the direction of the release position.

The locking pin may essentially be arranged at an arbitrary position in the socket insert. The locking pin may be arranged essentially centrally in the socket insert so that it need not be arranged in an edge portion of the socket insert or so that the normal arrangement of the electric contacts in the plug and in the socket insert, respectively, will not be hindered.

In order to guarantee also in the case of minor deviations of different coding projections that the electric plug connector can be activated only by a plug having a suitable coding aperture, the coding projection can be implemented such that its cross-section is complementary to the cross-section of the coding aperture.

Reliable guiding of the locking pin between the locking and release positions can advantageously be so conceived that, if the socket insert is provided with a longitudinal guide means for the locking pin, the cross-section of said longitudinal guide means is substantially equal to the cross-section of the coding projection. This also means that the cross-section of the locking pin corresponds substantially to that of the coding projection.

In accordance with a simple embodiment respective reception holes for electric contact pin bushings can be arranged around said longitudinal guide means in the socket insert. The contact pin bushings are insertable in these reception holes and, if necessary, they can be secured in position therein.

In order to prevent the coding projection of the locking pin to protrude beyond the socket insert more than necessary, the locking pin may project beyond said longitudinal guide means with its lower end located opposite the plug and it may be provided with a stop which is adapted to be brought into contact with a lower end of the longitudinal guide means.

In accordance with an advantageous embodiment, the stop can be implemented as upper end of an end sleeve of the locking pin which is open at the bottom, said end sleeve being adapted to accommodate at least part of a spring for applying a force to the locking pin in the direction of the locking-pin release position. In this way, the end sleeve serves both as a stop and as a means for accommodating the spring.

In order to support and guide at least part of said spring in the end sleeve, a centering pin can be arranged centrally in the end sleeve, at least part of the spring being adapted to be pushed onto said centering pin.

In order to rotatably support the socket insert in a simple manner and hold it simultaneously at a position suitable for insertion of the plug, the socket insert can be supported in an annular element at least in the lower end section thereof, the socket insert being adapted to be inserted together with said annular element in a plug housing which is releasably secured to the housing. The annular element may be produced from a friction-reducing material so that the socket insert can be rotated more easily. In addition, the annular element can serve to position the socket insert in the plug housing.

In order to be able to secure the plug housing together with the annular element and the socket insert to the housing of the electric plug connector in a simple manner, the annular element, the socket insert and the plug housing can be flush with one another at their respective lower ends facing the housing and they can project partially into a housing aperture in said housing. In the interior of the housing, suitable further means of the plug connector can be arranged, which can be used for securing e.g. the plug housing to the housing.

A simple possibility of fastening the plug housing and the housing can be seen in that the plug housing is provided with a circumferentially extending edge flange which is adapted to be releasably secured to an edge of the housing aperture. This is normally done by means of screws.

In order to permit an activation of the electric plug connector in a structurally simple manner, the plug housing can be adapted to be releasably connected to a diskshaped switching means within the housing, said switching means supporting the contact pin bushings and comprising at least one fastening disk and one switching disk which are rotatable relative to one another and disposable at two locking positions. At one locking position the electric plug connector is activated and at the other locking position the contact pin bushings are voltage-free. The fastening disk is releasably connected to the plug housing e.g. by means of screws and it is arranged in the housing such that it is secured against rotation relative thereto.

In order to prevent in this connection in a simple manner and directly by means of the locking pin a rotation of the socket insert for activating the electric plug connector, the fastening disk can be provided with a locking aperture on its front face facing the socket insert, the lower end of the locking pin being insertable into said locking aperture, whereby the socket insert and the fastening disk are coupled such that they are secured against rotation relative to one another. The locking pin has a cross-section corresponding to that of the coding projection, with the exception of the end sleeve area which is adapted to be pressed into the locking aperture such that it is secured against rotation relative thereto, if a plug is inserted in the socket insert which is not adapted to activate the electric plug connector.

In order to permit a simple displacement of the switching disk relative to the fastening disk, the annular element can be provided with a dog projecting towards the switching means, said dog extending through a slot guide means in the fastening disk and engaging a dog reception means arranged on the switching disk. If, in this connection, the socket insert is rotated by means of the inserted plug, the annular element and its dog will be rotated as well, whereby a corresponding rotation of the switching disk will take place via the dog reception means.

In order to guarantee first a rotation of the socket insert for activating the electric plug connector after insertion of the plug in the socket insert, the annular element may have a substantially L-shaped guide slot for an arresting insert which is supported on the outer circumference of the socket insert in a longitudinally displaceable manner, said arresting insert being adapted to be moved along the vertical L-leg by a plug collar of the plug, when the plug is being inserted in the socket insert, and subsequently along the horizontal L-leg by rotating the socket insert relative to the annular element. As long as the arresting insert is still arranged in the vertical L-leg in this connection, the socket insert can be rotated relative to the plug housing.

In order to prevent a relative rotation between the socket insert and the plug housing in a simple manner until the plug has been fully inserted, the arresting insert may be provided with an arresting projection which projects radially outwards relative to the socket insert and which is adapted to be brought into contact with edges of the guide slot. By engaging a complementary reception means in an inner wall of the plug housing, the arresting insert simultaneously guarantees that a relative rotation between the socket insert and the plug housing is not possible essentially until the horizontal L-leg of the guide slot has been reached. A rotation of the socket insert relative to the plug housing can only take place when said horizontal L-leg has been reached and, when the arresting projection has come into contact with an edge at the end of the horizontal L-leg, a joint rotation of the socket insert and of the annular element takes place. When this joint rotation is taking place, the switching disk is rotated by means of the dog of the annular element so as to activate the electric plug connector.

In order to support the arresting insert in the socket insert in a simple manner, the arresting insert can be supported in at least one support pocket such that it is displaceable in the longitudinal direction of the socket insert, said support pocket being arranged on the lower end section of the socket insert.

In order to reliably return the arresting insert to the vertical L-leg when the plug is being removed, a spring for applying a force to the arresting insert in the direction of the plug can be arranged between said arresting insert and the base of the support pocket.

In order to be able to correctly associate the socket insert with the contact pin bushings when the electric plug connector is being assembled and in order to permit simultaneously an insertion of the arresting insert at the location in question, a plurality of support pockets can be arranged along the circumference of the socket insert, said support pockets being especially arranged in juxtaposition. This provides a plurality of possibilities of arranging the arresting insert.

A simple embodiment of a coding projection can be seen in that said coding projection has a semicircular, divided circular, circular, bident, trident, multident or angular cross-section. The coding aperture in the plug has a complementary shape. The rest of the locking pin may also have such a cross-section down to the end sleeve arranged on the lower end thereof. It is also possible that only the coding projection has an e.g. semicircular cross-section, whereas the rest of the locking pin has a trident cross-section, and, if desired, the lower end of said locking pin, which is adapted to be inserted into the locking aperture of the locking disk, may have still another cross-section. Further combinations of cross-sections of identical or different shapes are obvious.

In order to simplify the assembly of the electric plug connector and in order to rotatably support the socket insert at the same time, the fastening disk can be provided with a guide wall projecting in the direction of the socket insert and engaging an annular groove in the lower end of the socket insert so as to rotatably support the same.

In order to convert, in a simple manner, the rotational displacement of the switching disk caused by the dog of the annular element during rotation of the socket insert so as to activate the plug connector or so as to switch it to a voltage-free state, the switching-disk back which is located opposite the fastening disk may have provided thereon at least one trip cam, which, in response to a rotational displacement of the switching disk by means of the dog, adjusts a switching means of an interrupter switch to a connection position or to an interrupt position, said interrupter switch being arranged in the housing.

In the following, advantageous embodiments of the present invention will be explained in detail making reference to the figures in the drawing, in which.

Figure 1:
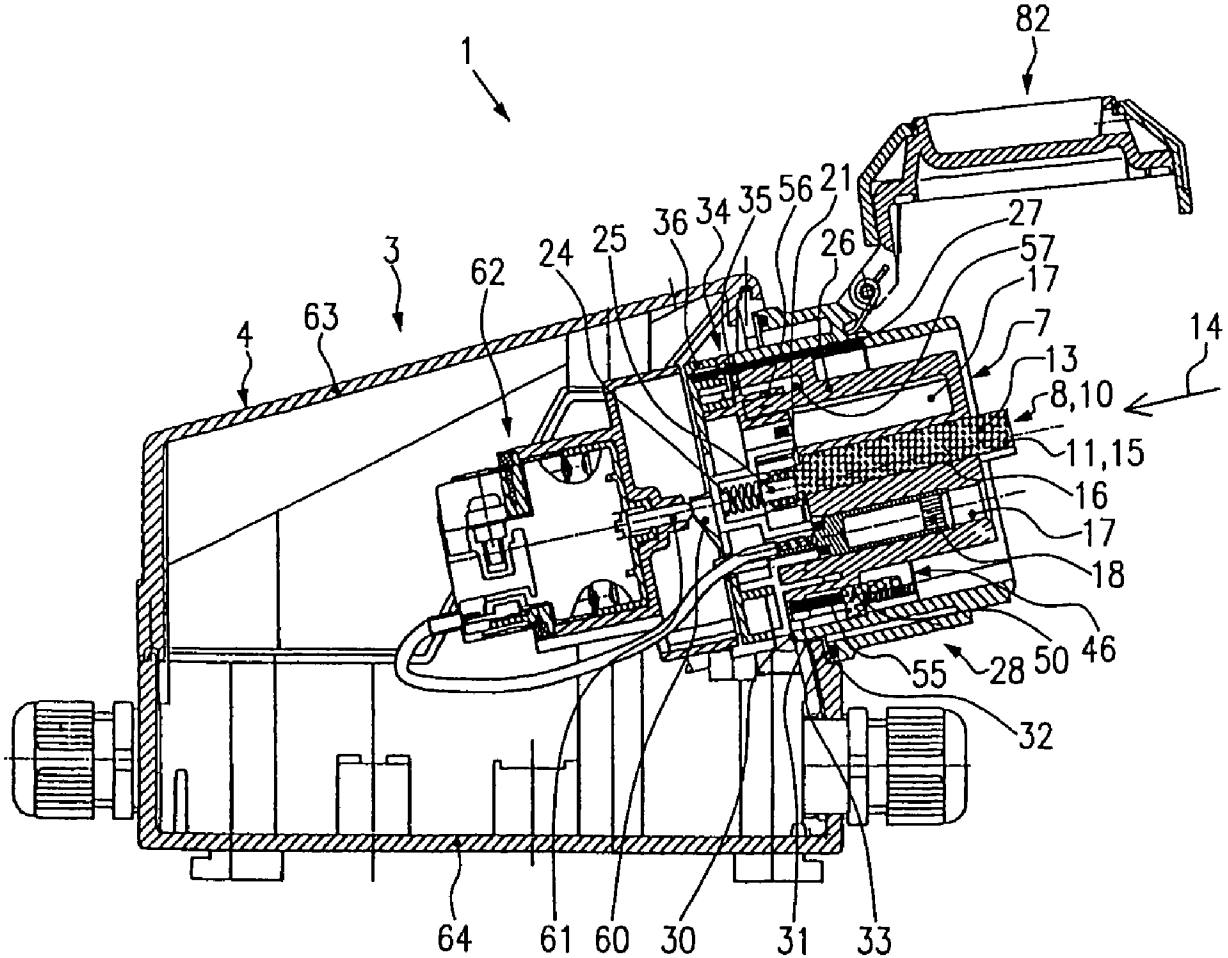
FIG. 1 shows a longitudinal section through a socket of an embodiment of the plug connector according to the present invention.

FIG. 1 shows in a longitudinal section a plug connector 1 comprising a socket 3 into which a plug 2, not shown, is insertable from the plug-in direction 14.

The socket 3 comprises a housing 4 consisting of an upper housing section 63 and a lower housing section 64. These housing sections are releasably interconnected by a screw-type connection. At the housing end shown on the right hand side in FIG. 1, a housing aperture 31 is arranged. The edge 33 of said housing aperture 31 has releasably secured thereto a plug housing 28 by means of an edge flange extending circumferentially on the lower end 30 of said plug housing 28. A cover 82 is pivotably supported on the plug housing 28.

The plug housing 28 has arranged therein a socket insert 7 whose lower end section 26 is surrounded by an annular element 27. The plug housing 28, the annular element 27 and the socket insert 7 are arranged such that their lower ends 30, 29 and 58 are flush with one another, cf. also FIG. 3, and they are inserted through the housing aperture 31 into the housing 4. In said housing 4 a switching means 34 is arranged, which comprises a fastening disk 35 and a switching disk 36. The two disks 35, 36 are arranged concentrically with one another and have the same radius. The fastening disk 35 is adapted to be screw-fastened to the lower end 30 of the plug housing 28 by means of fastening projections 76, cf. FIG. 10, which are not shown in FIG. 1. The plug housing 28 and the fastening disk 35 are in this way secured to the housing 4 in such a way that they are secured against rotation relative to one another. The fastening disk 35 is provided with a circularly extending guide wall 56 on its front facing the socket insert 7. The guide wall 56 is inserted into a complementary annular groove 57 on the lower end 58 of the socket insert 7 so as to rotatably support said socket insert 7.

Figure 2:
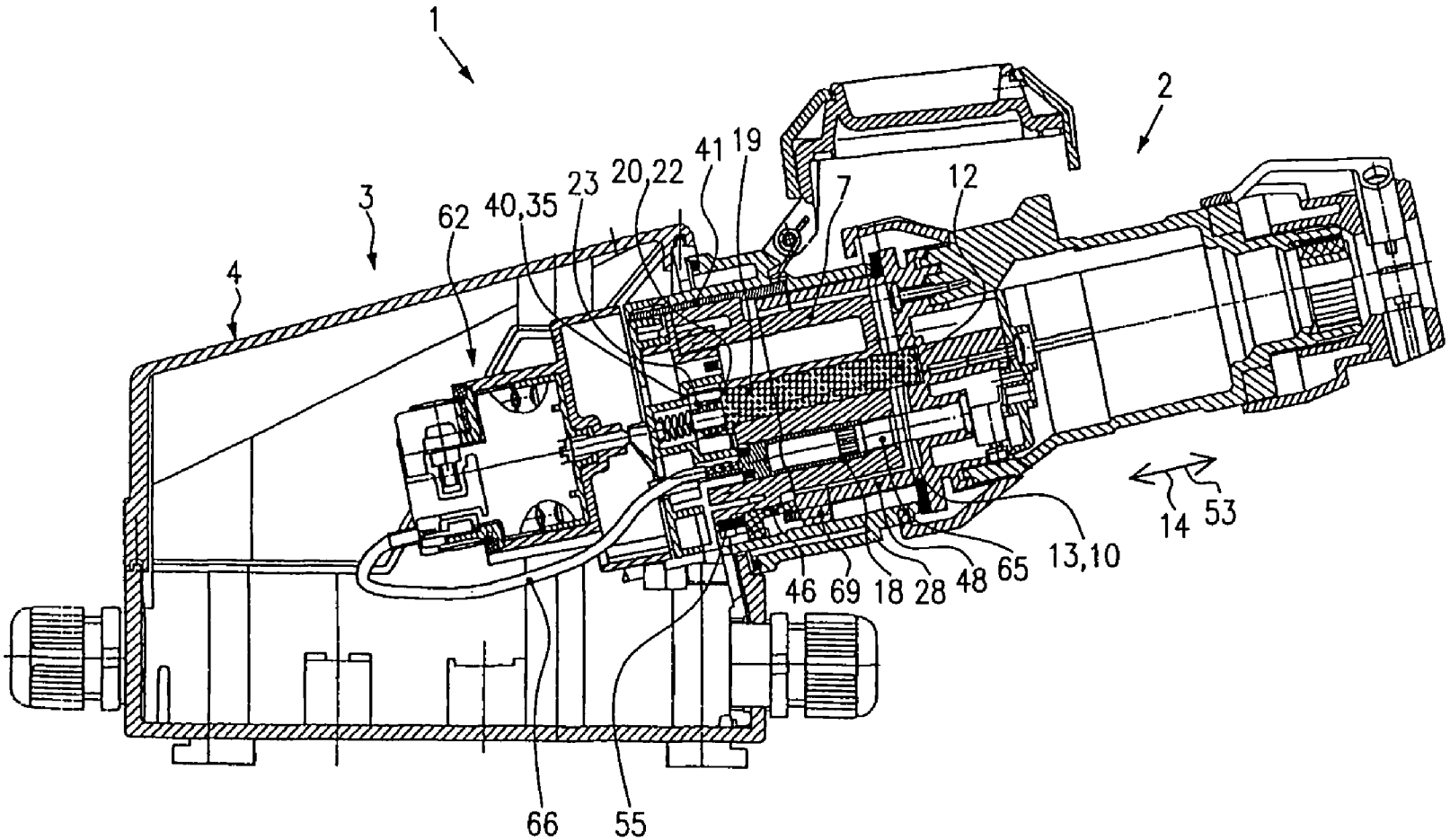
FIG. 2 shows the socket according to FIG. 1 having the plug inserted therein.
Figure 10:
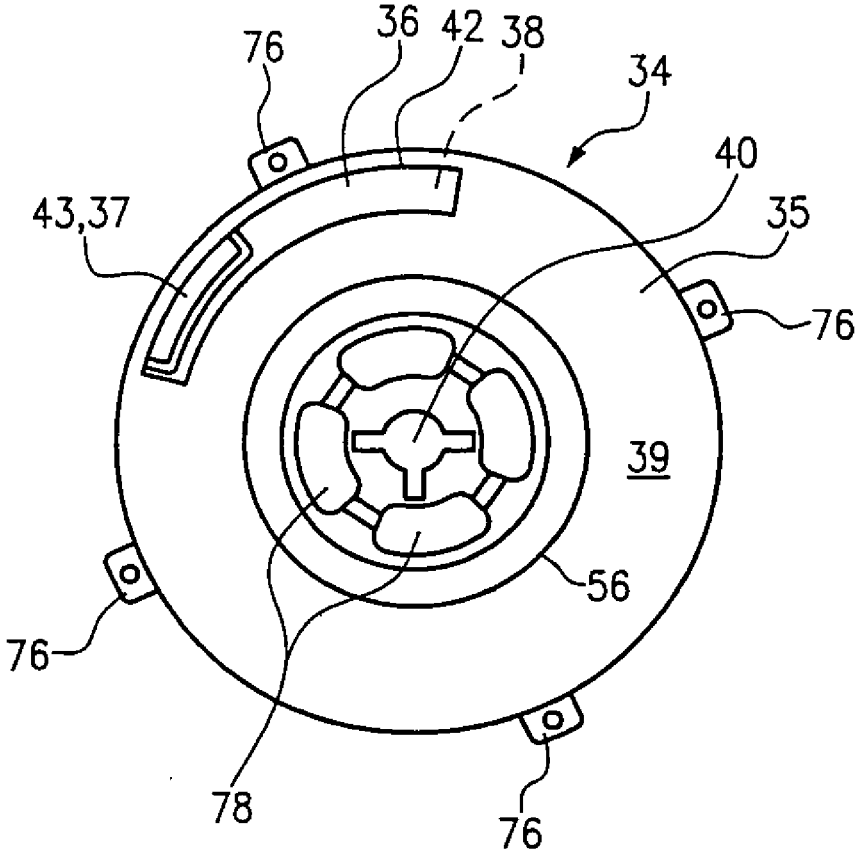
FIG. 10 shows a top view of a switching means comprising a fastening disk and a switching disk.

A locking aperture 40, cf. FIGS. 2 and 10, is arranged centrally in said fastening disk 35. A lower end of a locking pin 13 defining a locking means 8 is insertable into said locking aperture 40. The lower end 19 of the locking pin 13 has arranged thereon an end sleeve 23 which is open in the direction of the locking aperture 40. Said end sleeve 23 has centrally arranged therein a centering pin 25 which projects beyond said end sleeve 23 and which has attached thereto part of a spring 24. The spring 24 rests on the bottom of the locking aperture 40 and applies a force to the locking pin 13 in the direction of the locking-pin release position 10 shown in FIG. 1. At this release position, the lower end 19 of said locking pin 13 is arranged outside of the locking aperture 40 so that the socket insert 7 can be rotated relative to the switching means 34.

Figure 3:
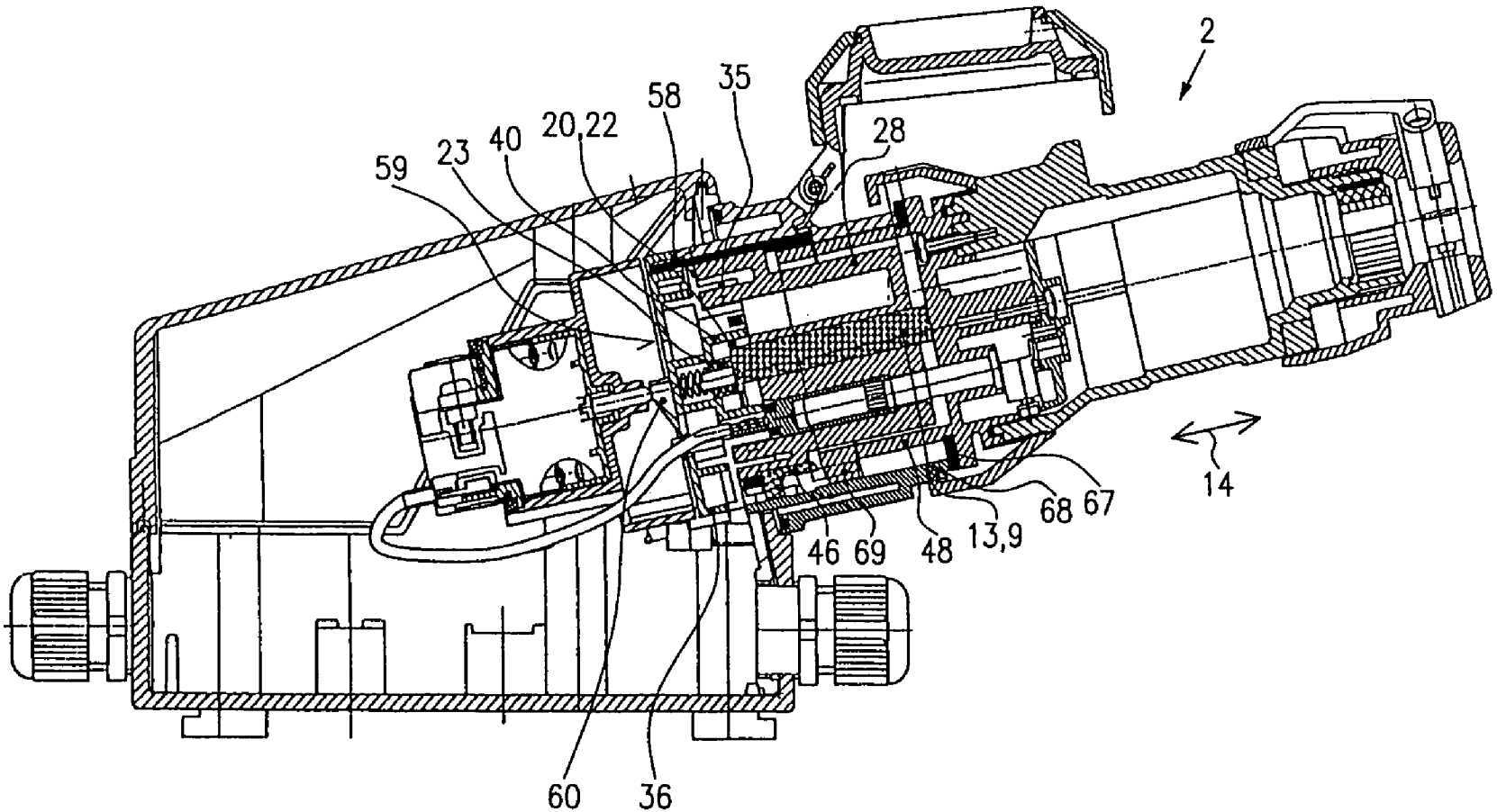
FIG. 3 shows the socket according to FIG. 1 with a plug which is not suitable for activating the electric plug connector.

At least one trip cam 60 is arranged on the back 59 of the switching disk 36, said back 59 being arranged in opposed relationship with the fastening disk 35, cf. also FIG. 3. At the locking position 37 at which the switching disk 36 is locked relative to the fastening disk 35, cf. also FIG. 10, the trip cam 60 forces a pin-shaped switching means 61 towards an interrupter switch 62, said locking position 37 being shown in FIG. 1. The electric plug connector 1 is thus switched to a voltage-free state by the interrupter switch 62 in which a connection between cables (not shown) extending up to the socket 3 and the plug 2 inserted in said socket 3 is interrupted.

An arresting insert 46 is supported in a longitudinally displaceable manner on the lateral surface of the socket insert 7. In the sectional view according to FIG. 1, this arresting insert 46 is L-shaped. A spring 55 applies a force to the arresting insert 46 in the direction of the plug 2, cf. FIG. 2.

Three, four or more reception holes 17 are formed in the interior of the socket insert 7, said reception holes 17 having contact pin bushings 18 inserted therein. Said contact pin bushings 18 are connected through cables 66, cf. FIG. 2, to the back of the interrupter switch 62 and they are held by the fastening disk 35, cf. FIGS. 10 and 11.

The release position 10 of the locking pin 13 is determined by a stop 20 which is defined by an upper end of the end sleeve 23, cf. also FIG. 2. The stop 20 abuts on a lower end 21 of a longitudinal guide means 16. The locking pin 13 is displaceably guided in said longitudinal guide means 16.

The locking pin 13 has, especially on the upper end 15 thereof, a coding projection 11 having a specific cross-section. In the embodiment according to FIG. 1, this cross-section does not vary along the whole locking pin 13 up to the lower end 19 thereof. When the locking pin 13 has its lower end 19 inserted in the locking aperture 40 against the force of the spring 24, it is arranged at the locking position 9, cf. also FIG. 3.

FIG. 2 shows a section through the socket 3 according to FIG. 1 in a condition in which the plug 2 is inserted. In this figure and also in the following figures, components which are identical with the components shown in FIG. 1 are provided with identical reference numerals and only part of these components is mentioned again. Furthermore, for further describing FIG. 2 and the following figures, reference is additionally made to the description with respect to FIG. 1.

The plug 2 has a structural design which is known per se. According to the present invention, the end face of said plug is provided with a coding aperture 12 whose cross-section corresponds to the cross-section of the locking pin 13. According to FIG. 2, the end 15, cf. FIG. 1, of the locking pin 13 is inserted in the coding aperture 12. This has the effect that the locking pin 13 remains in the release position 10 also in the attached condition of the plug 2.

Figure 8:
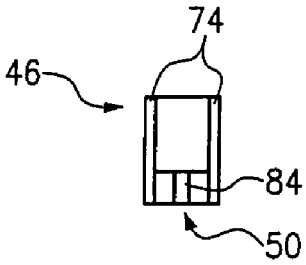
FIG. 8 shows a side view of an arresting insert.
Figure 9:
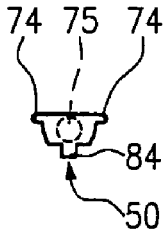
FIG. 9 shows a top view of the arresting insert according to FIG. 8.

The plug 2 is provided with a plug collar 48 surrounding the socket insert 7 in a sleeve-like manner and plugged in between the plug housing 28 and the socket insert 7. The front end of the plug collar 48 has arranged thereon an edge cam 69 which projects radially outwards. The edge cam 69 forces the arresting insert 46 towards the switching means 34 against the force of the spring 55. This has the effect that an arresting projection 50, cf. e.g. FIGS. 8 and 9, is disengaged from a guide means formed on the inner side of the plug housing 28, whereupon the socket insert 7 with the annular element 27 will be rotatable relative to the plug housing 28. The socket insert 7 is rotated by rotating the plug 2 whose contact pins 65 are inserted in the respective contact pin bushings 18.

Figure 5:
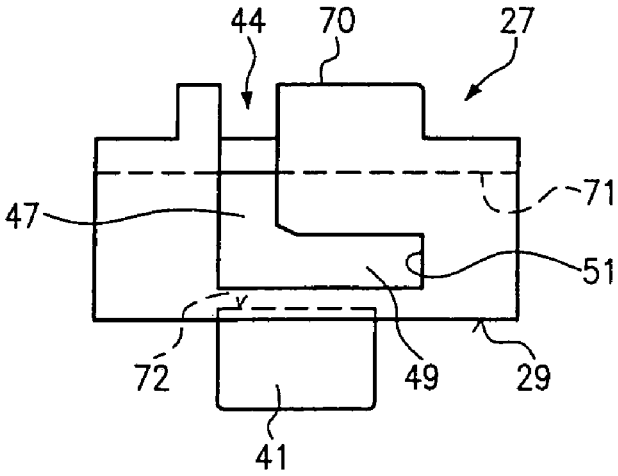
FIG. 5 shows a side view of an annular element.

The rotation of the socket insert 7 and the annular element 27 can be transferred to the switching disk 36 by means of a dog 41 projecting from said annular element 27 in the direction of the switching means 34, cf. also FIG. 5. The switching disk 36 can in this way be switched over between its various locking positions 37, 38, cf. FIG. 10. At the locking position shown in FIG. 2, the trip cam 60 forces the pin-shaped switching means 61 towards the interrupter switch 62. By rotating the switching disk 36 to the other locking position according to FIG. 10, the trip cam 60, cf. FIG. 1, is disengaged from the switching means 61, whereby the plug connector 1 is activated, i.e. the electric connection to the plug 2 is established.

FIG. 3 shows a representation analogously to FIG. 2 with a plug 2 having no coding aperture 12.

Also in this case, the arresting insert 46 is displaced in the direction of the switching means 34 by edge cams 69 in the inserted condition of the plug 2. The socket insert 7 and the annular element 27 are therefore, in principle, rotatable relative to the plug housing 28, and the locking pin 13 is in its locking position 9 having been displaced by the end face of the plug 2 according to FIG. 3. At this locking position 9, the lower end 19 of said locking pin 13 is inserted in the locking aperture 40 of the fastening disk 35. The socket insert 7 and the fastening disk 35 are in this way coupled such that they are secured against rotation relative to one another so that neither the socket insert 7 nor the annular element 27 with the dog 41, cf. FIG. 1 or 2, can be rotated relative to the switching disk 36.

Figure 4:
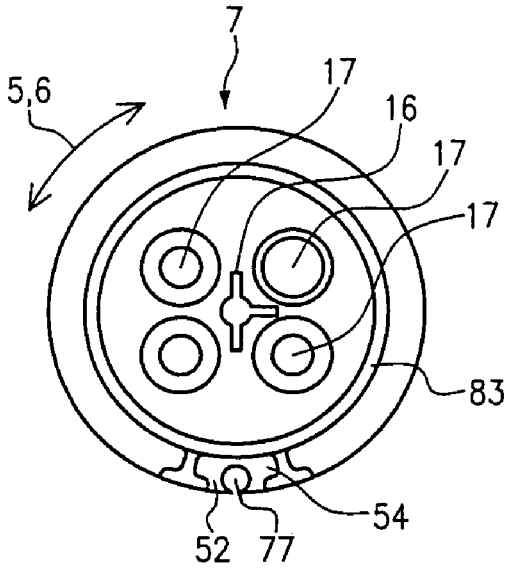
FIG. 4 shows a top view of the socket insert in the condition in which it is arranged in the socket according to FIG. 1.

FIG. 4 shows a front view of the socket insert 7 according to FIGS. 1 to 3. This socket insert 7 can be rotatably displaced between an off position 5 an and on position 6 in that it is rotated by means of the plug, cf. e.g. FIG. 2. When the socket insert 7 is being rotated, the annular element 27 is carried along, cf. the statements made hereinbelow, whereby a change-over between the locking positions 37, 38, cf. FIG. 10, of the switching disk 36 can be effected by means of the dog 41, cf. again FIG. 2.

In an end face of the socket insert 7 four reception holes are visible, said reception holes having arranged therein respective contact pin bushings 18, cf. FIGS. 1 to 3. The longitudinal guide means 16 is arranged centrally in said end face; in the present embodiment, said longitudinal guide means has a trident cross-section, the three teeth being arranged in a T-shaped configuration and extending from an approximately circular centre.

In the lower end section 26, cf. e.g. FIG. 1, the socket insert 7 is provided with a shoulder 83 extending radially outwards and including a plurality of support pockets 52, only one of these pockets being shown in FIG. 4. The support pockets 52 are arranged along the circumference of socket insert 7. A hole 77 is arranged in a base 54 of the support pockets 52, said hole 77 having inserted therein a lower end of the spring 55, cf. FIGS. 1 to 3. The support pockets 52 define a guide means for the arresting insert 46, cf. also FIGS. 8 and 9. The annular element 27 is rotatably supported on the shoulder 83 and on upper ends of the support pockets 52, respectively, by means of a shoulder 71 formed on the inner side of said annular element 27, cf. FIG. 5.

FIG. 5 shows a front view of the annular element 27. The inner surface of said annular element 27 is provided with the shoulder 71. The wall of the annular element 27 has formed therein an L-shaped guide slot 44. This guide slot 44 comprises a vertical L-leg 47 and a horizontal L-leg 49 extending at right angles to said first-mentioned L-leg. The vertical L-leg 47 extends in the longitudinal direction 53, cf. FIG. 2, of the socket insert 7. The arresting insert 46 is guided in said vertical L-leg, cf. FIGS. 8 and 9. After insertion of the plug 2, cf. e.g. FIGS. 2 and 3, the arresting insert 46 is pressed down along the vertical L-leg 47 in the direction of the dog 41 and can then be displaced relative to the annular element 27 along the horizontal L-leg 49 up to the edge 51 of the guide slot 44 by rotating the socket insert 7.

Opposite to the guide slot 44, the dog 41 projects from the lower end 29 of the annular element 27, a shoulder 72 being formed between the dog 41 and the annular element 27. When the socket insert 7 is inserted in the plug housing 28, this shoulder 72 abuts on the lower end 30 of the plug housing 28.

Figure 6:
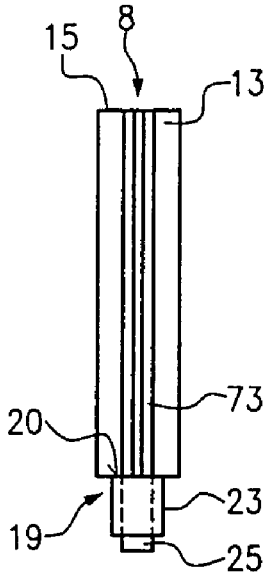
FIG. 6 shows a side view of a locking pin.

FIG. 6 shows a front view of the locking pin 13 as locking means 8. In correspondence with the cross-section of the longitudinal guide means 16, cf. FIG. 4, said locking pin 13 is implemented as a trident pin, cf. also FIG. 7. The three teeth are arranged in T-shaped configuration relative to one another and extend from an approximately circular centre. The upper end 15 of the locking pin 13 normally projects beyond the longitudinal guide means 16 of the socket insert 7 in the direction of the plug 2, cf. also FIGS. 1 to 3. The lower end 19 has provided thereon the end sleeve 23 in which the centering pin 25 is centrally arranged. The end sleeve 23 is arranged in the locking aperture 40, cf. FIGS. 1 and 2, an upper end of said end sleeve 23 defining a stop 20, cf. also FIG. 2.

Figure 7:
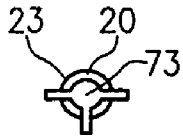
FIG. 7 shows a top view of the locking pin according to FIG. 6.

FIG. 7 shows a top view of the locking pin 13 according to FIG. 6. In particular, it can be seen how the three teeth of the cross-section are arranged in a T-shaped configuration around the circular centre 73. The diameter of the end sleeve 23 is larger than a respective diameter of the said circular centre 73 so that the stop 20 is defined by the end sleeve 23 projecting radially beyond said circular centre 73.

FIG. 8 shows a front view of the arresting insert 46. The arresting insert 46 is plate-shaped and it has lateral guide projections 74 formed thereon. On the lower end of the arresting insert 46, the arresting projection 50 protrudes, which has an approximately semicircular cross-section provided with a lug 84 that projects radially outwards. This lug 84 constitutes part of the arresting projection 50 and is arranged in a complementary groove on the inner side of the plug housing 28 until the arresting projection 50 is displaced into the horizontal L-leg 49, cf. FIG. 5, of the annular element 27. The socket insert 7 and the plug housing 28 are in this way coupled such that they are secured against rotation relative to one another.

FIG. 9 shows a top view of the arresting insert 46 according to FIG. 8. The arresting projection 50 has formed therein a hole 75 which is open towards the lower end, cf. FIG. 8, of the arresting insert 46 so as to accommodate a spring 55, cf. FIGS. 1 to 3.

FIG. 10 shows a top view of the switching means 34 and especially of the fastening disk 35. This fastening disk 35 is circular and provided with four fastening projections 76 protruding from the circumference of the circle radially outwards. The fastening projections 76 serve to secure the switching means 34 to the lower end 30 of the plug housing 28 by means of screws, cf. FIGS. 1 to 3.

On a front face 39 of the fastening-disk 35 facing the socket insert 7, the guide wall 56 is arranged, which engages the annular groove 57 on the lower end 58 of the socket insert 7. The locking aperture 40 is surrounded by the guide wall 56. The cross-section of said locking aperture 40 corresponds to the cross-section of the locking pin 13. It should be pointed out that the diameter of the circular centre of the locking aperture 40 corresponds to the diameter of the end sleeve 23, since said end sleeve 23 is displaceably supported in said circular centre, cf. FIGS. 1 to 3.

The locking aperture 40 is surrounded by four lead-through passages 78 extending after the fashion of elongate holes in a curved configuration around the locking aperture 40. Support webs are arranged between the individual lead-through passages 78, complementary webs 80, cf. FIG. 11, of a holder 79 being rotatably supported on said support webs. The lead-through passages 78 open into a circular opening of the switching disk 36 and serve as passage means for cables 66, cf. FIG. 2, having contact pin bushings 18 arranged on the ends thereof. When the socket insert 7 is rotated relative to the annular element 27, cf. the rotational displacement of the arresting insert 46 along the horizontal L-leg 49, the cables 66 are displaceable along the lead-through passage 78 in a corresponding manner.

The front face 39 of the fastening disk 35 has formed therein a curved slot guide means 42 through which the switching disk 36 can be seen. The latter is provided with a dog reception means 43 into which the dog 41, cf. FIGS. 1 to 3, of the annular element 27 can be inserted. By rotating the annular element 27 with its dog 41, the switching disk 36 can be displaced between locking positions 37 and 38 with the aid of the dog reception means 43.

Figure 11:
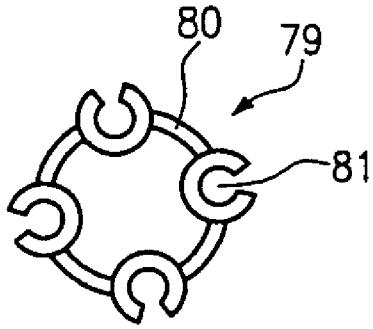
FIG. 11 shows a top view of a rotary-type holder for contact pin bushings.

FIG. 11 shows a top view of the holder 79. The webs 80 of said holder 79 are rotatably supported on the connection webs between the lead-through passages 78, cf. FIG. 10. For holding the lower ends of the contact pin bushings 18, cf. FIGS. 1 to 3, the holder 79 is provided with support eyes 81 having a passage slot which opens radially outwards. The lower ends of the contact pin bushings 18 are adapted to be inserted into said support eyes 81 through said passage slot and, subsequently, these lower ends rest on top of the support eyes.

Figure 12A:
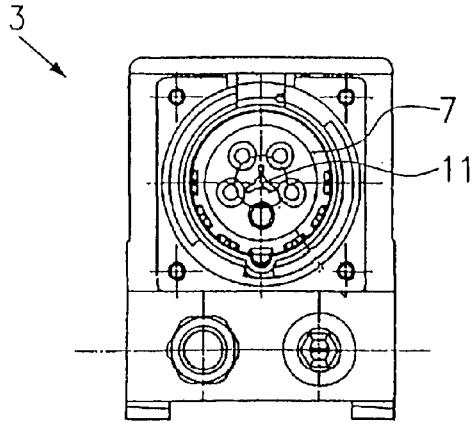
FIGS. 12A and 12B show a front view of a matching socket (FIG. 12A) and plug (FIG. 12B) according to a first embodiment.
Figure 12B:
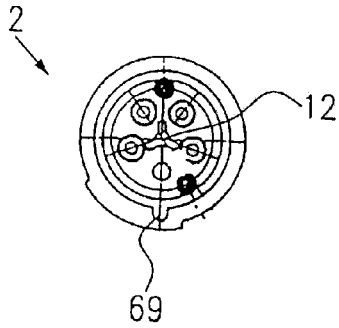
Figure 13A:
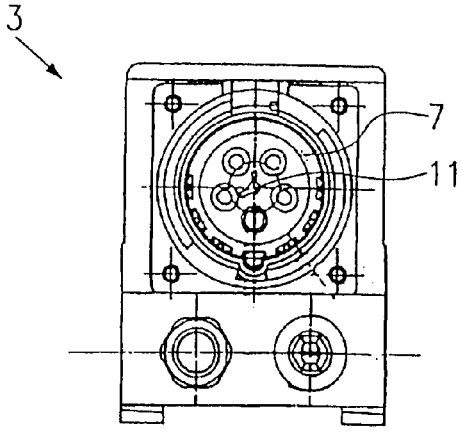
FIGS. 13A and 13B show a view, analogously to FIGS. 12A and 12B, of a second embodiment of a plug and socket.
Figure 13B:
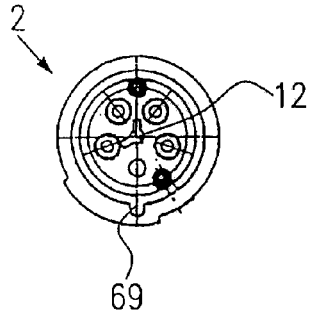
Figure 14A:
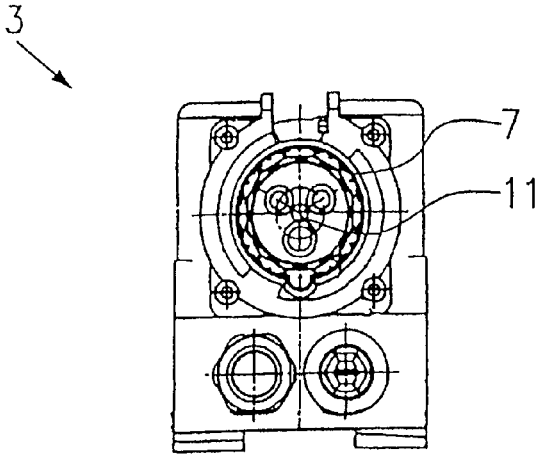
FIGS. 14A and 14B show a view, analogously to FIGS. 12A and 12B, of a third embodiment of a plug and socket.
Figure 14B:
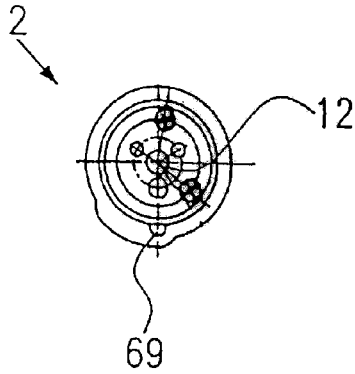

FIGS. 12 to 14 show three different embodiments for plugs 2 and sockets 3 with different codings of the locking pin 13 or the coding projection 11 and of the coding aperture 12.

In FIG. 12 the coding takes place by the trident cross-section of the coding projection 11, the three individual teeth being arranged at angles of 120° relative to one another. The coding aperture 12 is implemented in a complementary manner.

In FIG. 13 the coding takes place by a bident coding projection, the two individual teeth enclosing an angle of approx. 120°. This applies analogously to the coding aperture 12.

In FIG. 14 the coding projection is circular, cf. also the coding aperture 12 in the plug 2 in question.

In the following, the mode of operation of the plug connector according to the present invention will be explained briefly on the basis of the figures.

In particular in explosion-prone areas, a voltage-free connection is established between the plug and the socket, the respective electric plug connector being activated, i.e. the voltage switched through to the plug 2, only after the connection of these two components.

In FIG. 3, a plug 2 which is not compatible with the socket 3 has been inserted, the plug being, however, compatible as far as the contact pins and the like are concerned. Due to the fact that a suitable coding aperture 12 does not exist, the locking pin 13 is displaced to its locking position 9 when the plug 2 is attached to the socket insert 7. At this position, the lower end 19 of the locking pin 13 is inserted in the locking aperture 40 of the fastening disk 35. The locking aperture 40 and the locking pin 13 have complementary cross-sections which permit the fastening disk 35 and the socket insert 7 to be coupled such that they are secured against rotation relative to one another.

Normally, the socket insert 7 is adapted to be rotated together with the annular element 27 relative to the plug housing 28 by pressing down the arresting insert 46 by edge cams 69 of the plug 2. However, due to the fact that the engagement of the locking pin 13 with the locking aperture 40 prevents a rotation of the socket insert 7 relative to the switching means 34, the trip cam 60 cannot be disengaged from the pin-shaped switching means 61 of the interrupter switch 62 by rotating the switching disk 36 to a different locking position. The socket insert is therefore still maintained in a voltage-free state by the interrupter switch 62.

In contrast to the above, the plug 2 according to FIG. 2 shows in the end face thereof a coding aperture 12 whose cross-section is complementary to the coding projection 11 of the locking pin 13. The locking pin 13 is therefore still arranged in its release position 10 even when the plug 2 has been attached to the socket insert 7. At this release position, only the end sleeve 23 of the locking pin 13 is arranged in the locking aperture 40 so that the socket insert 7 and the annular element 27 can be rotated relative to the fastening disk 35 for displacing the switching disk 36 by means of the dog 41. In the case of such a rotation also the trip cam 60 is rotated relative to the pin-shaped switching means 61, which has the effect that said switching means 61 moves out of the interrupter switch 62 and that the interrupter switch supplies voltage to the socket insert 7.

The invention claimed is:

1. An electric plug connector, in particular for explosion-proof areas, comprising:

a plug, a socket including at least a housing and a socket insert supported in said housing such that the socket insert is rotatable between first and second positions, said socket insert being rotated between its positions by means of the plug inserted in the socket, and a locking element supported in the socket insert such that the locking element is displaceable between a locking position and a release position, said locking element being provided with at least one coding projection which, in the condition in which the plug is inserted in the socket insert, is arranged in a complementary coding aperture in the plug thus arranging the locking element at its release position, wherein the socket insert is rotatable between the first and second positions when the locking element is in the release position;

wherein the locking element is implemented as a locking pin which is supported in the socket insert such that it is longitudinally displaceable between the locking and release positions essentially in the plug-in direction of the plug.

2. An electric plug connector according to claim 1 wherein, when occupying the release position, the locking pin projects with one of its ends as a coding projection beyond the socket insert in the direction of the plug.

3. An electric plug connector according to claim 1 wherein the locking pin has a force applied thereto in the direction of the release position.

4. An electric plug connector according to claim 1 wherein the locking pin is arranged essentially centrally in the socket insert.

5. An electric plug connector according to claim 1 wherein the coding projection is implemented such that its cross-section is complementary to the cross-section of the coding aperture.

6. An electric plug connector according to claim 1 wherein the coding projection has a semicircular, divided circular, circular, bident, trident or multident or an angular cross-section.

7. An electric plug connector according to claim 1 wherein the socket insert is provided with a longitudinal guide means for the locking pin, the cross-section of said longitudinal guide means being substantially equal to the cross-section of the coding projection.

8. An electric plug connector according to claim 7 wherein the locking pin projects beyond said longitudinal guide means with its lower end located opposite the plug and is provided with a stop which is adapted to be brought into contact with a lower end of the longitudinal guide means.

9. An electric plug connector according to claim 8 wherein the stop is implemented as an upper end of an end sleeve of the locking pin which is open at the bottom, said end sleeve being adapted to accommodate at least part of a spring for applying a force to the locking pin in the direction of the locking-pin release position.

10. An electric plug connector according to claim 9 wherein a centering pin is arranged centrally in the end sleeve, at least part of the spring being adapted to be pushed onto said centering pin.

11. An electric plug connector according to claim 7 wherein reception holes for electric contact pin bushings are arranged around said longitudinal guide means in the socket insert.

12. An electric plug connector according to claim 11 wherein the socket insert is supported in an annular element at least in the lower end section thereof, the socket insert being adapted to be inserted together with said annular element in a plug housing which is releasably secured to the housing.

13. An electric plug connector according to claim 12 wherein the annular element, the socket insert and the plug housing are flush with one another at their respective lower ends facing the housing and project partially into a housing aperture in said housing.

14. An electric plug connector according to claim 13 wherein the plug housing is provided with a circumferentially extending edge flange which is releasably secured to an edge of said housing aperture.

15. An electric plug connector according to claim 13 wherein the plug housing is adapted to be connected to a diskshaped switching means within the housing, said switching means supporting the contact pin bushings and comprising at least one fastening disk and one switching disk which are rotatable relative to one another and disposable at two locking positions.

16. An electric plug connector according to claim 15 wherein the fastening disk is provided with a locking aperture on its front face facing the socket insert, the lower end of the locking pin being insertable into said locking aperture, whereby the socket insert and the fastening disk are coupled such that they are secured against rotation relative to one another.

17. An electric plug connector according to claim 15 wherein the fastening disk is provided with a guide wall projecting in the direction of the socket insert and engaging an annular groove in the lower end of the socket insert so as to rotatably support the same.

18. An electric plug connector according to claim 15 wherein the annular element is provided with a dog projecting towards the switching means, said dog extending through a slot guide means in the fastening disk and engaging a dog reception means arranged on the switching disk.

19. An electric plug connector according to claim 18 wherein the switching-disk back which is located opposite the fastening disk has provided thereon at least one trip cam, which, in response to a rotational displacement of the switching disk by means of the dog, adjusts a switching means of an interrupter switch to a connection position or to an interrupt position, said interrupter switch being arranged in the housing.

20. An electric plug connector according to claim 15 wherein the annular element has a substantially L-shaped guide slot for an arresting insert which is supported on the outer circumference of the socket insert in a longitudinally displaceable manner, said arresting insert being adapted to be moved along the vertical L-leg by a plug collar of the plug, when the plug is being inserted in the socket insert, and subsequently along the horizontal L-leg by rotating the socket insert relative to the annular element.

21. An electric plug connector according to claim 20 wherein the arresting insert is provided with an arresting projection which projects radially outwards relative to the socket insert and which is adapted to be brought into contact with edges of the guide slot.

22. An electric plug connector according to claim 20 wherein the arresting insert is supported in at least one support pocket such that it is displaceable in the longitudinal direction of the socket insert, said support pocket being arranged on the lower end section of the socket insert.

23. An electric plug connector according to claim 22 wherein a spring for applying a force to the arresting insert in the direction of the plug is arranged between said arresting insert and the base of the support pocket.

24. An electric plug connector according to claim 22 wherein support pockets are arranged along the circumference of the socket insert, said support pockets being especially arranged in juxtaposition.

* * * * *